United States Patent [19]

Endo et al.

[11] 4,366,801

[45] Jan. 4, 1983

[54] PLASMA IGNITION SYSTEM

[75] Inventors: Hiroshi Endo; Yasuki Ishikawa; Iwao Imai, all of Yokosuka, Japan

[73] Assignee: Nissan Motor Company, Limited, Kanagawa, Japan

[21] Appl. No.: 303,025

[22] Filed: Sep. 17, 1981

[30] Foreign Application Priority Data

Sep. 18, 1980 [JP] Japan ..... 55-128595

[51] Int. Cl.[3] ..... F02P 1/00

[52] U.S. Cl. ..... 123/620; 123/596; 123/605; 123/606; 123/633; 123/634; 123/640; 123/643; 123/653

[58] Field of Search ..... 123/620, 596, 605, 606, 123/640, 653

[56] References Cited

U.S. PATENT DOCUMENTS

| | | | |
|---|---|---|---|
| 3,788,293 | 1/1974 | Anderson | 123/620 |
| 3,835,830 | 9/1974 | Shepherd | 123/620 |
| 3,906,919 | 9/1975 | Asih | 123/596 |
| 4,027,198 | 5/1977 | Linkroum | 123/596 |
| 4,317,068 | 2/1982 | Ward | 123/620 |

FOREIGN PATENT DOCUMENTS

| | | | |
|---|---|---|---|
| WO81/00885 | 4/1981 | PCT Int'l. Appl. | 123/620 |

*Primary Examiner*—Ronald B. Cox

*Attorney, Agent, or Firm*—Lowe, King, Price & Becker

[57] ABSTRACT

A plasma ignition system for an internal combustion engine which can prevent irregular ignition when the insulation between the electrodes of the spark plug deteriorates due to carbon on the electrodes, and further can prevent electrical noise from being emitted. The system according to the present invention comprises a plurality of independent plasma ignition energy storing condensers, switching units, and boosting transformers one each for each of the engine cylinder. In this system, a high tension is generated at the secondary coil of the boosting transformer to generate a spark between the electrodes of the plug and subsequently a large current is passed through the electrodes by the remaining energy stored in the condenser.

18 Claims, 16 Drawing Figures

PLASMA IGNITION SYSTEM

BACKGROUND OF THE INVENTION

1. Field of the Invention

The present invention relates generally to a plasma ignition system, and more particularly to a configuration of the plasma ignition system in which the condensers storing the high ignition energy for each cylinder are independently connected to the output terminal of a DC-DC converter in order to perform plasma ignition by applying the current discharged from the condenser to the space between the electrodes of the respective spark plugs through respective boosting transformers when the respective switching units are turned on at the predetermined ignition times. 2. Description of the Prior Art The plasma ignition system has been developed as a means of obtaining reliable ignition and for improving the reliability of fuel combustion even under engine operating conditions such that combustion is liable to be unstable when the engine is operated within a light-load region or when the mixture of air and fuel is weak.

In prior-art plasma ignition systems, a current flowing from a battery to the primary winding of an ignition coil is turned on or off by a contact point actuated according to the crankshaft revolution in order to generate high tension pulse signals in the secondary winding of the coil. These high voltage pulses are sent to the distributor through a diode and are next applied, in order, to the respective spark plugs through the respective high-tension cables. Accordingly, a spark is generated between the electrodes of the spark plug, and subsequently a high-energy electric charge of a relatively low voltage is passed from a plasma ignition power supply unit between the electrodes for a short period of time to generate a plasma.

In the prior-art plasma ignition system, however, since the output voltage from the plasma ignition power supply unit is simultaneously applied to all the spark plugs, an unwanted discharge can be generated between the electrodes at times other than the desired ignition times, thus resulting in the problem of irregular discharge.

Further, a large amount of power is consumed within the diode.

Furthermore, in the prior-art plasma ignition system, since the high tension cables are connected between the spark plug and the power supply unit, an impulsive current flows through the cables, thus resulting in another problem such that strong wide-band electrical noise is generated from the high tension cables.

A more detailed description of the prior-art plasma ignition system will be made under DETAILED DESCRIPTION OF THE PREFERRED EMBODIMENT with reference to the attached drawings.

SUMMARY OF THE INVENTION

With these problems in mind therefore, it is the primary object of the present invention is to provide a plasma ignition system which can reliably prevent irregular discharge between the electrodes, eliminate the need of a high voltage resistant diode to reduce the power consumption, thus improving the reliability and efficiency of the plasma ignition.

It is another object of the present invention is to provide a plasma ignition system in which a single high tension cable can be used both for supplying the spark discharge voltage and the plasma ignition current, thus making the wiring compact.

It is a further object of the present invention to provide a plasma ignition system in which it is possible to prevent electrical noise generated when the spark plug is discharged from being emitted therefrom.

To achieve the above-mentioned object, the plasma ignition system according to the present invention comprises a DC-DC converter for boosting a DC supply voltage to a high tension, a plurality of ignition energy condensers for storing electric ignition energy, which are connected to the output of the converter, a plurality of switching units for applying the ignition energy to the plasma spark plugs at an appropriate ignition timing, and a plurality of boosting transformers.

Further, in this plasma ignition system according to the present invention, a single high tension cable is used to supply both the spark discharge voltage and the plasma ignition current in order to make the wiring compact.

Furthermore, in this plasma ignition system according to the present invention, the spark plug, boosting transformer, auxiliary condenser are shielded by a metal shield and a cylindrical noise-shorting condenser is provided in the metal shield, surrounding the input wire, in order to prevent electric noise generated when the spark plug is discharged.

BRIEF DESCRIPTION OF THE DRAWINGS

The features and advantages of the plasma ignition system according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

To facilitate understanding of the present invention, a brief reference will be made to a prior-art plasma ignition system referring to FIGS. 1 and 2, and more specifically to FIG. 2.

Figure 1:
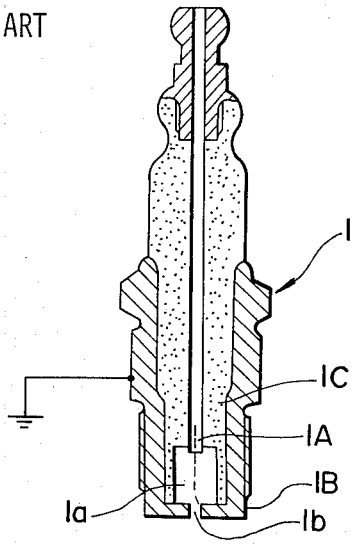
FIG. 1 PRIOR ART
FIG. 1 is a longitudinal cross-sectional view of a plasma spark plug used with a plasma ignition system.

FIG. 1 shows a typical plasma spark plug 1 used with a prior-art plasma ignition system. In this plug, the gap between a central electrode 1A and a side electrode 1B is surrounded by an electrically insulating material 1*c* such as ceramic so as to form a small discharge space 1*a*. FIG. 2 shows a circuit diagram of a prior-art plasma ignition system in which the above-mentioned plasma spark plugs 1 are used. In this circuit, the current flowing from a battery 3 to the primary winding of an ignition coil 4 is turned on or off by a contact point 2 which is actuated by the crankshaft revolution to generte a high tension pulse signal with a maximum voltage of from −20 to −30 KV in the secondary winding of the ignition coil 4. The high tension pulse is sent to a distributor 6 through a diode 5 to prevent the plasma energy from being lost, and next is supplied, in firing order, to the spark plugs 1 arranged in the combustion chambers of the respective cylinders through respective high-tension cables 7 which each include a resistance. The spark plug 1 to which a high tension pulse is applied generates a spark between the central electrode 1A and the side electrode 1B, and subsequently a high energy electric charge (several Joules) of a relatively low voltage (from −1 to −2 KV) is passed between the electrodes for a short period of time (several hundreds of microseconds) from a plasma ignition power supply unit 8 in order to produce a plasma within the discharge space 1*a*. Therefore, it is possible to ignite the mixture surely and to stabilize the combustion performance by injecting the plasma from a jet hole 1*b* in the spark plug 1 into the combustion chamber. In this figure, the reference numeral 9 denotes diodes protecting the plasma ignition power supply unit 8.

Figure 2:
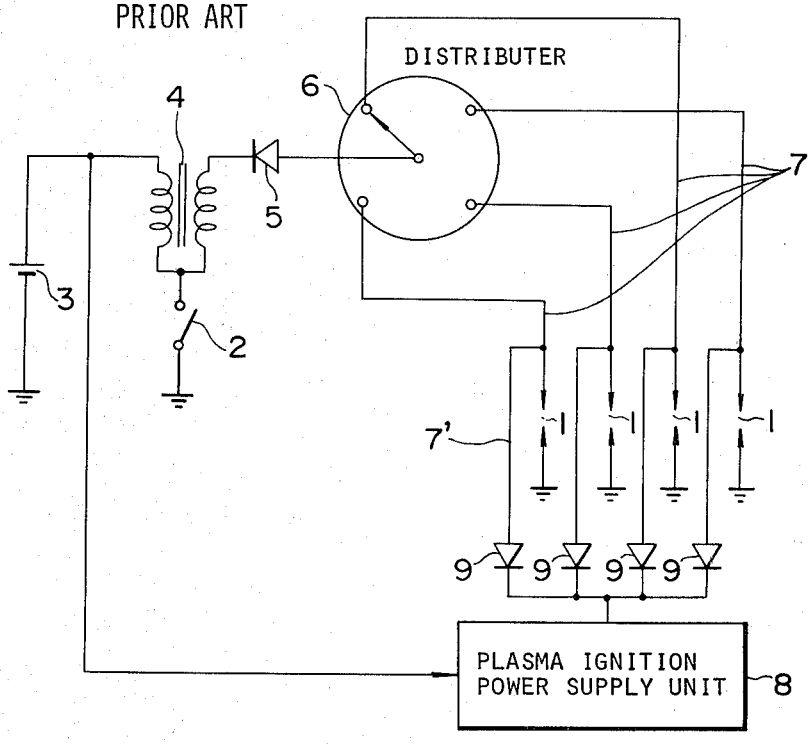
FIG. 2 PRIOR ART
FIG. 2 is a schematic block diagram of a typical prior-art plasma ignition system.

In the prior-art plasma ignition system, however, as depicted in FIG. 2, since the output voltage from the plasma ignition power supply unit 8 is simultaneously applied to all the spark plugs 1 in the cylinders, when the insulation between the electrodes of the spark plug 1 breaks down owing to the influence of humidity changes in the mixture during the intake stroke or of carbon adhering to the spark plug 1, an unwanted discharge can be generated between the electrodes of the spark plug 1 by the voltage of the power supply unit 8 at times other than the desired ignition times, thus resulting in a problem with irregular discharge such that discharge is generated in the spark plug 1 other than at the predetermined ignition times.

Further, a large amount of power is consumed when the plasma ignition current is passed through the high voltage resistant diodes 9, amounting to about half of the total discharge power.

Furthermore, since high tension cables 7′ having a resistance of several tens of ohms or less connect the terminals of each spark plug 1 to the power supply unit 8 through the high voltage resistant diodes 9, when the spark plug 1 to which a high tension ignition pulse is applied from the ignition coil 4 begins to discharge, an impulsive current (several tens of amperes in peak value and several nano-seconds in pulse width) flowing around the spark plug 1 propagates to the high tension cables 7′, thus resulting in another problem such that strong wode-band electrical noise is emitted from the high tension cables 7′ in the range from several tens of MHz to several hundreds of MHz.

Figure 3:
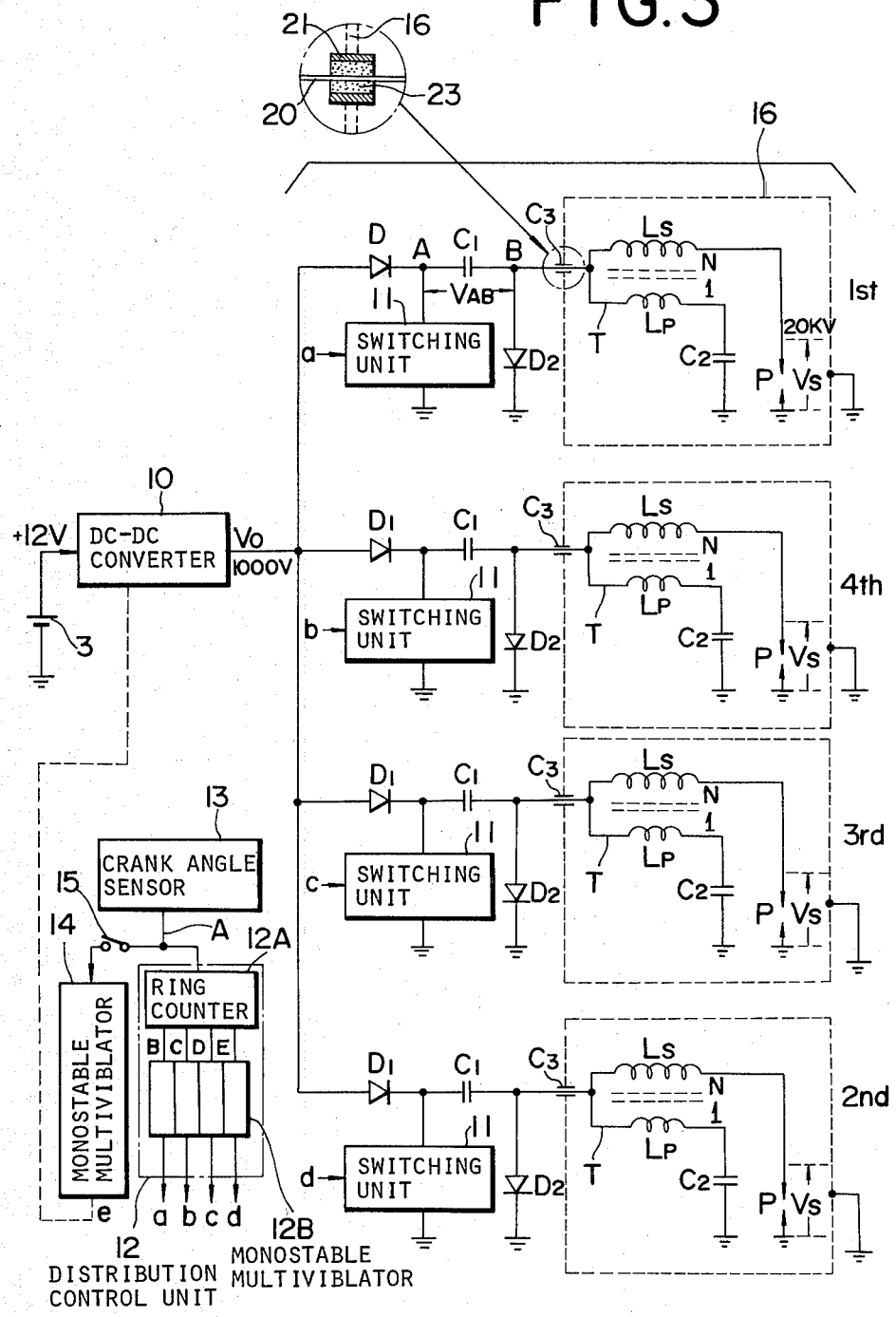
FIG. 3 is a schematic block diagram of a preferred embodiment of the plasma ignition system according to the present invention.

In view of the above description, reference is now made to FIGS. 3–11, and more specifically to FIG. 3.

In the plasma ignition system according to the present invention, a plurality of condensers to store the ignition energy are provided one for each cylinder; part of the currents discharged from these condensers is passed through the primary coils of the respective boosting transformers; the high tensions generated from the respective secondary coils thereof are supplied to the respective spark plugs in order to perform the spark discharge therein; the remaining discharge current is supplied to the respective spark plugs to perform the plasma ignition.

With reference to the attached drawings, there is explained a preferred embodiment of the plasma ignition system according to the present invention.

In FIG. 3 in which the whole system configuration is illustrated, for each cylinder a diode $D_1$, an ignition-energy storing condenser $C_1$ (about 1μ F in capacity), the core of a small-capacitance cylindrical condenser $C_3$ (about 1000 pF in capacity), and the central electrode of an spark plug P through the secondary coil Ls of a boosting transformer T are connected to the output terminal Vo of a common DC-DC converter 10 able to boost a DC battery voltage of 12 V to a DC voltage of 1000 V. The point between each diode $D_1$ and condenser $C_1$ is grounded through switching units 11, and the switching units 11 are connected to and controlled by the output terminals of a distribution control unit 12 made up of 4-bit ring counters 12A and monostable multivibrators 12B, independently, so that the switching units are each turned on when the respective signals a–d are inputted thereto from the respective output terminals of the distribution control unit 12 at the respective predetermined ignition times. In addition, the point between each condenser $C_1$ and each cylindrical condenser $C_3$ is grounded through diode $D_2$ to prevent currents flowing through the boosting transformers when the respective condensers $C_1$ are being charged.

The primary coils Lp of the boosting transformers T are grounded through respective auxiliary condensers $C_2$ smaller in capacity (about 0.2μ F) than the ignition energy charging condensers $C_1$. In this embodiment, each system of spark plug P, boosting transformer T, and auxiliary condenser $C_2$ is shielded by a metal casing 16, and the respective cylindrical condensers $C_3$ are provided in the metal casing, with the grounded wall of the cylindrical condenser $C_3$ brought into contact with the wall of the metal casing 16.

In the cylindrical noise-shorting condenser $C_3$, as illustrated by an enlarged fragmentary view in FIG. 3, a wire 20 is passed through the central hole thereof and the cylindrical metal housing 21 thereof is fixed to a grounded metal shield 16 with insulation 23 disposed therebetween. Therefore, electrical noise in the wire 20 can be effectively shorted to the metal casing 16, that is, to the ground beyond the insulation 23, so that it is possible to prevent noise from being emitted therefrom.

Now follows an explanation of the operations of the plasma ignition system thus constructed.

A high voltage of Vo (e.g. 1000 V) outputted from the DC-DC converter 10 is applied to the condenser $C_1$ through the diodes $D_1$ and $D_2$ to charge the condenser $C_1$ with a high ignition energy (0.5 Joule).

Figure 4:
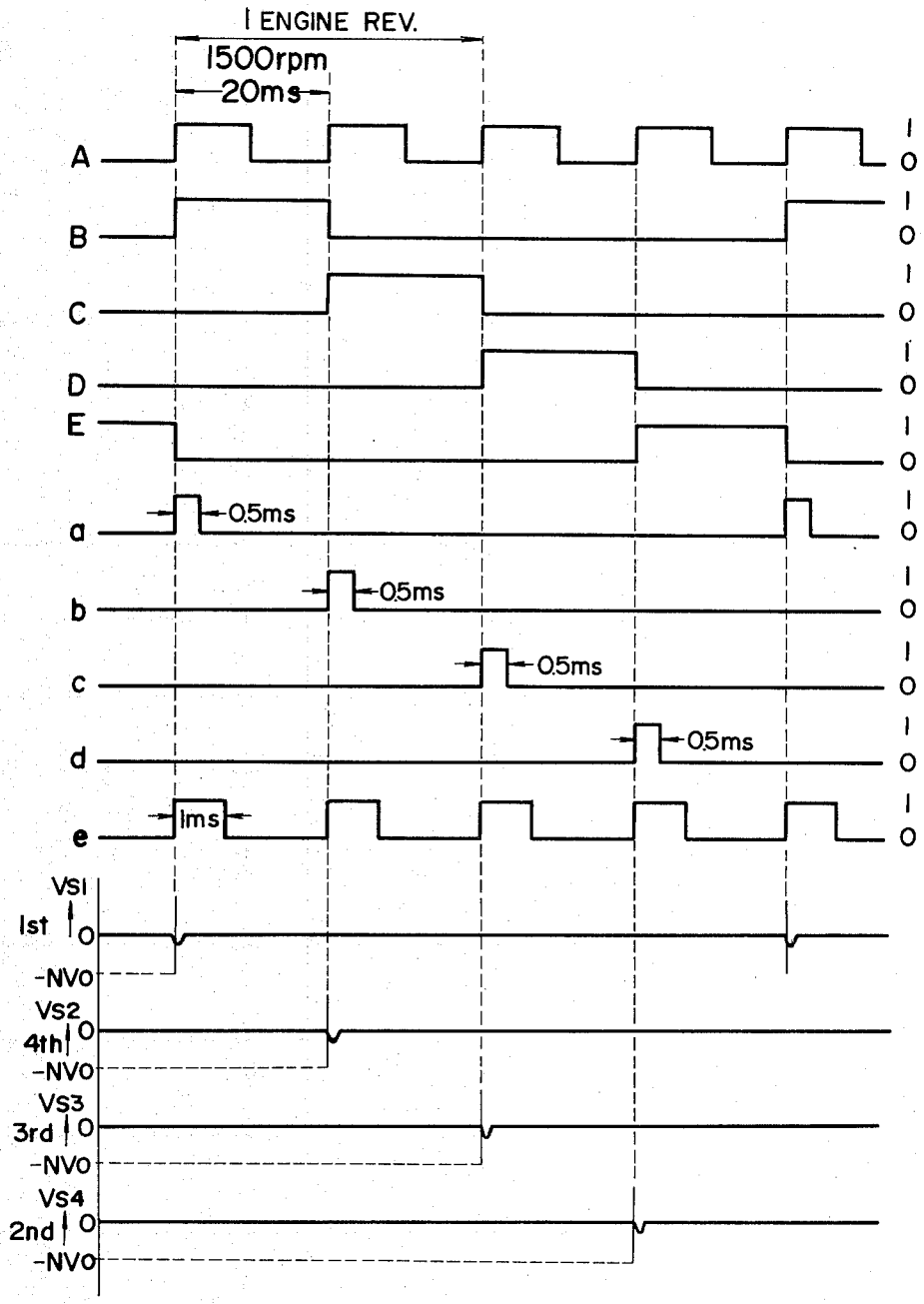
FIG. 4 is waveform representations showing ignition signal pulses generated at various points of the plasma ignition system shown in FIG. 3.

When the signal output from the crank angle sensor 13 which generates a pulse signal twice every crankshaft revolution in synchronization with the crankshaft revolution is inputted to the 4-bit ring counter 12A of the distribution control unit 12, the ring counter 12A generates four HIGH-level pulse signals of width 0.5 ms in firing order in accordance with the predetermined ignition timing, as shown by the pulse signals of B-E of FIG. 4. These pulses are inputted to the respective monostable multivibrators 12B in order to output the respective ignition pulse signals of a-d from the respective output terminals to the respective switching units 11.

When an HIGH-level ignition pulse signal is inputted to a switching unit 11, the switching unit 11 is turned on to ground the terminal A of the condenser $C_1$. At this moment, since the potential at the terminal A drops abruptly from $V_o$ to zero, the difference in potential $V_{AB}$ between terminals A and B of the condenser $C_1$ changes abruptly from zero to $-V_o$ due to the influence of the inductance of the primary coil $L_P$ of the boosting transformer.

Thus, a high voltage of $-V_o$ is applied to the respective boosting transformer T through the center of the cylindrical condenser $C_3$. Since a current is passed from the condenser $C_1$ to the condenser $C_2$ which is smaller in capacity than $C_1$ through the primary coil Lp, a high-frequency voltage with the maximum value of about $\pm V_o$ is generated between the terminals of the primary coil Lp.

If the winding ratio of the primary coil Lp to the secondary coil Ls is 1:N (e.g. 20), a high frequency voltage of about $\pm NV_o$ (e.g. $\pm 20$ KV) is generated across the secondary coil Ls, since the voltage of the secondary coil is boosted so as to be N-times greater than that of the primary coil, so that discharge occurs between the central electrode and the side electrode of the spark plug P.

Thus, once a discharge occurs within the spark plug P, the space between the electrodes becomes conductive with a certain discharge resistance and therefore the high energy (about 0.5 Joule) stored in the condenser $C_1$ is subsequently applied between the electrodes of the spark plug P for a short period of time through the secondary coil Ls (in this case the peak value of the current is kept below several tens of amperes).

When this high energy electrical charge is supplied, a plasma is produced within the discharge space of the spark plug P, so that the mixture is ignited perfectly. Further, in this embodiment, the switching units 11 are turned on by the HIGH-level ignition pulse signals a-d output from the distribution control unit 12 in order to supply high energy to the corresponding spark plugs P in the same order from a to d, so that the cylinders are fired in the order of $1^{st}$, $4^{th}$, $3^{rd}$ and $2^{nd}$ cylinder. The voltage Vs between the electrodes of each spark plugs P changes as shown in FIG. 4.

In the plasma ignition system thus constructed, since a plasma ignition current is supplied to the spark plug P only at the time of ignition and since it is possible to prevent high voltage from being applied thereto during the energization of the other spark plugs, it is possible to reliably avoid irregular discharge such that unwanted ignition occurs within the cylinders during the other strokes.

Further, since there is no need to provide a high voltage resistant diode on the discharge line from the condenser $C_1$ to the gap between the electrodes of the spark plug P, it is possible to prevent the consumption of ignition energy in the diode, thus markedly improving the power supply efficiency of the ignition system.

Further, since it is possible to use a single high tension cable to supply the spark discharge voltage to the spark plug P at the start of ignition and for supplying the plasma ignition current during ignition,, it is possible to make the wiring compact.

Furthermore, since the spark plug P, boosting transformer T, and auxiliary condenser $C_2$ are shielded by the metal casing 16 as shown in the figure and since the cylindrical noise-shorting condenser $C_3$ is fitted to the input terminal, it is possible to prevent electrical noise generated by impulsive currents flowing near the spark plug P at the start of the discharge from leaking out.

Next, various types of preferred embodiments of the switching unit 11 are described below.

Figure 5A:
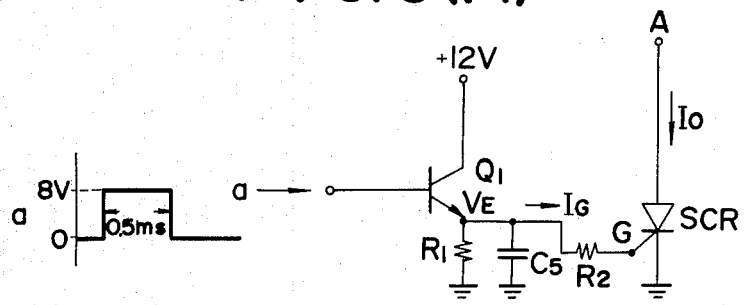
FIG. 5(A) is a circuit diagram of a first embodiment of the switching unit used for the plasma ignition system according to the present invention.

FIG. 5(A) shows a first embodiment in which a SCR (silicon control rectifier or thyristor) is used as the switching unit 11. In this switching unit, when the ignition pulse a sent from the distribution control unit 12 changes to a HIGH-level of 8 V, a transistor $Q_1$, operating in emitter follower mode is turned on and the emitter voltage becomes $V_E=7.2$ V. At this moment, since a gate current of $I_G=(7.2-V_{GK})/R_2$ (where $V_{GK}$ is the gate voltage of the SCR) is passed through the gate G of the SCR, terminal A of the condenser $C_1$ is grounded.

In this embodiment, since it is necessary to turn off the switching unit 11 after the high plasma ignition energy has been supplied from the condenser $C_1$ to the spark plug P, the SCR must be turned off by reducing the current $I_o$ flowing through the SCR to a value below the holding current. To turn off the SCR, a switch 15 in FIG. 3 disposed between the crankshaft angle sensor 13 and the monostable multivibrator 14 is turned on to apply a pulse signal of pulse width 1 ms generated from the crankshaft angle sensor 13 to the monostable multivibrator 14. Therefore, a pulse signal e with a pulse width of 1 ms is generated from the output terminal of the monostable multivibrator 14 and is applied to a function-stopping terminal of the DC-DC converter 10 to stop the output therefrom for a period of 1 ms. After the time of 1 ms has elapsed, the DC-DC converter 10 starts to operate again, the SCR is fired by the ignition pulse a from the distribution control unit 12, thus forming the plasma intermittently.

Figure 5B:
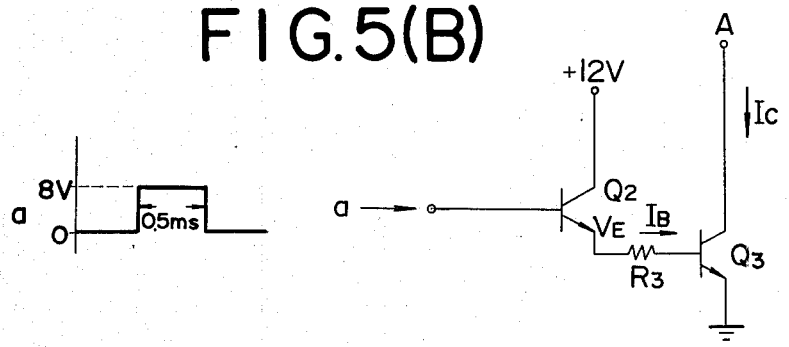
FIG. 5(B) is a circuit diagram of a second embodiment of the switching unit used for the plasma ignition system according to the present invention.

FIG. 5(B) shows a second embodiment in which a high voltage resistant transistor is used as the switching unit 11. In the figure, when the ignition pulse signal a sent from the distribution control unit 12 changes to a HIGH-level of 8 V, the emitter voltage of the transistor $Q_2$ becomes $V_E=7.2$ V, and a base current $I_B=(7.2-0.8)/R_3$ is passed through the base of the high voltage resistant transistor $Q_3$ to turn on the transistor $Q_3$, so that terminal A of the condenser $C_1$ is grounded. In this embodiment, when a high energy electric charge is supplied from the condenser $C_1$ to the spark plug P, since the collector current $I_c$ of the transistor $Q_3$ reaches its peak value $I_{cp}$ of several tens of amperes, the value of $R_3$ must be determined so as to satisfy the condition that the base current $I_B$ is greater than $I_{cp}/h_{FE}$, where $h_{FE}$ is the current amplification.

Figure 5C:
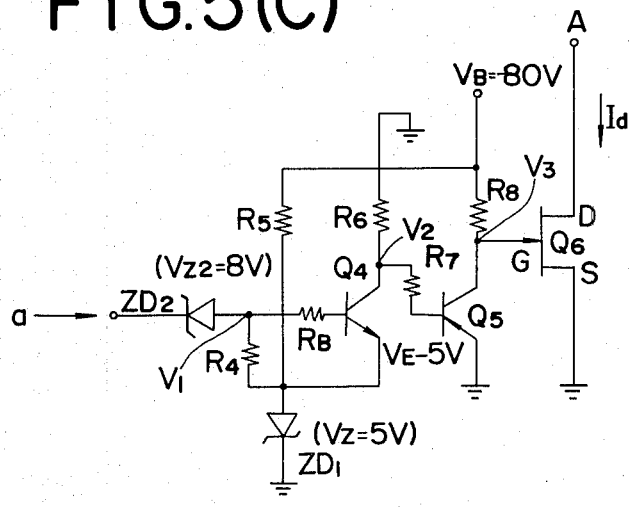
FIG. 5(C) is a circuit diagram of a third embodiment of the switching unit used for the plasma ignition system according to the present invention.
Figure 5D:
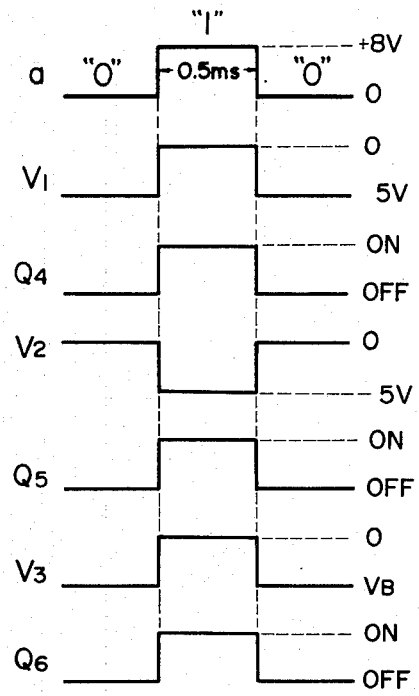
FIG. 5(D) is waveform representations showing ignition signal pulses generated at various points of the circuit of FIG. 5(D)

FIG. 5(C) shows a third embodiment in which an electrostatic induction type transistor (a kind of high voltage resistant FET) is used as the switching unit 11, and FIG. 5(D) shows the signal waveforms at various points in the circuit. In the figures, since a current is supplied to a Zener diode $ZD_1$ with a Zener voltage of $V_{Z1}=5$ V from the supply voltage $V_B=-80$ V through a resistor $R_5$, the emitter voltage $V_c$ of the transistor $Q_4$ is always kept at $V_E=-5$ V. Accordingly, when the ignition pulse is LOW-level, the voltage $V_1$ at the point where a Zener diode $ZD_2$ with a Zener voltage $V_{Z2}=8$ V and a resistor $R_4$ are connected to each other is $-5$ V, so that a transistor $Q_4$ is kept turned off. Therefore, the voltage $V_2$ at the point where a resistor $R_6$ and a resistor $R_7$ are connected to each other is zero, so that a transistor $Q_5$ is kept turned off. That is to say, since the voltage $V_3$ of the gate G of the electrostatic induction type transistor $Q_6$ is $V_3=V_B(=-80\text{ V})$ being kept below the pinch-off voltage $V_P$, the transistor $Q_6$ is kept turned off.

In this embodiment, when the ignition pulse signal a changes to a HIGH-level of 8 V, the voltage $V_1$ drops to 0 V to turn on the transistor $Q_4$, and therefore the collector voltage $V_2$ of the transistor $Q_4$ becomes $-5$ V to turn on the transistor $Q_5$. Accordingly, the gate voltage $V_3$ of the transistor $Q_6$ becomes 0 V and the transistor $Q_6$ is turned on to connect the drain D and the source S, so that terminal A of the condenser $C_1$ is grounded. In this case, since the drain current $I_d$ of the transistor $Q_6$ reaches several tens of amperes in peak value when a high energy electric charge is supplied from the condenser $C_1$ to the spark plug P, it is necessary to use a transistor $Q_6$ the internal resistance of which is less than several ohms when the transistor is on.

Next follows a theoretical analysis of the transient phenomena of the ignition circuit used with the plasma ignition system according to the present invention, in order to examine the variation of the discharge voltage $V_s$ generated between the electrodes of the spark plug.

Figure 6A:
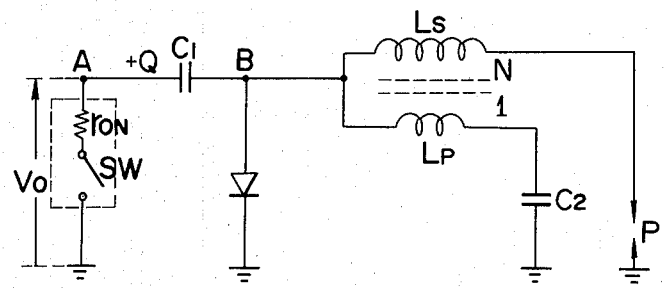
FIG. 6(A) is an equivalent circuit diagram of the cylinder ignition circuit used for the plasma ignition system according to the present invention.

When the symbol $r_{on}$ denotes the internal resistance of the switching unit 11 when the unit is on, the ignition circuit for each cylinder can be represented as in FIG. 6(A). When the terminal A of the condenser $C_1$ previously charged up to $V_o$ is grounded by turning the switch SW on, since the voltage at terminal B changes from zero to $-V_o$, it is possible to illustrate the equivalent circuit of FIG. 6(A) by FIG. 6(B).

Figure 7A:
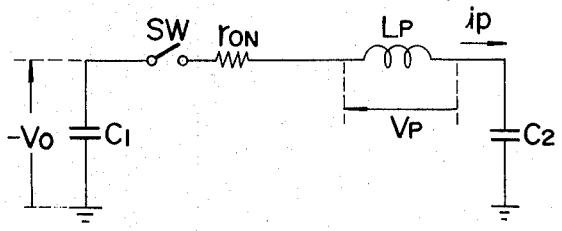
FIG. 7(A) is an equivalent circuit diagram including the primary coil of the boosting transformer shown in FIG. 6(A)
Figure 6B:
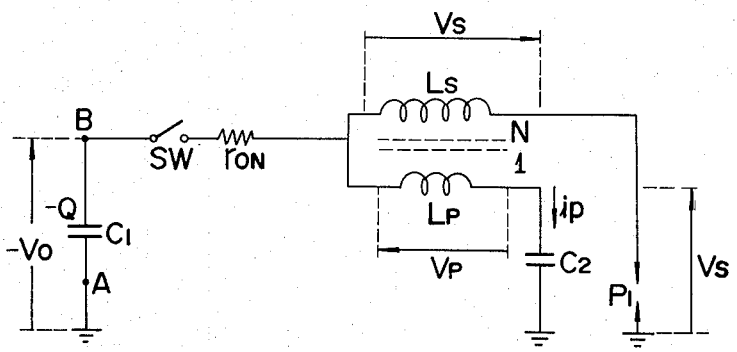
FIG. 6(B) is another equivalent circuit diagram of the circuit shown in FIG. 6(A)

Further, the equivalent circuit including the primary coil $L_P$ of the boosting transformer T shown in FIG. 6(B) can be illustrated as in FIG. 7(A). In this equivalent circuit, since the capacity of the condenser $C_2$ (0.2 μF) is small compared with that of the condenser $C_1$ (1 μF), even when a current flows from the condenser $C_1$ to the condenser $C_2$ and thereby the terminal voltages of the two condensers $C_1$ and $C_2$ become equal to each other in the steady state, the terminal voltage of the condenser $C_1$ decreases to only 80 percent of the initial value, with the result that it is approximately possible to illustrate the equivalent circuit shown in FIG. 7(A) as the one shown in FIG. 7(B), wher the condenser $C_1$ is replaced by a DC supply voltage of $-V_o$.

Figure 7B:
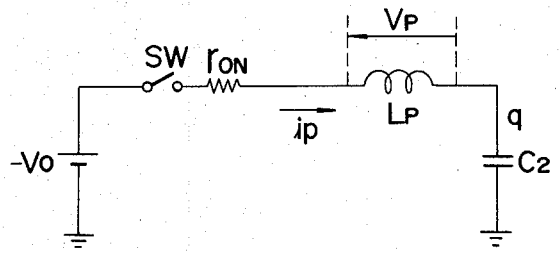
FIG. 7(B) is another equivalent circuit diagram of the circuit shown in FIG. 7(A)

In the circuit shown in FIG. 7(B), the electric charge q stored in the condenser $C_2$ during the period of time t immediately after the switch SW is turned on can be expressed as follows, if the symbol i denotes the current flowing through the circuit at that moment:

$$L_p \cdot \frac{d^2q}{dt^2} + r_{on}\frac{dq}{dt} + \frac{q}{C^2} = -V_o \tag{1}$$

if $r_{on}<2\,L_P/C_2$, the solution of the above equation (1) is:

$$q = -C_2V_o\left(1 - \frac{\xi^{-\alpha_1 t}}{\sqrt{1-\frac{C_2}{L_p}\left(\frac{r_{on}}{2}\right)^2}}\cdot\sin(\beta_1 t+\theta)\right) \tag{2}$$

Since the current i can be obtained by dq/dt from the equation (2), $$i = -\frac{V_o}{\sqrt{\frac{L_p}{C_2}-\left(\frac{r_{on}}{2}\right)^2}}\,\xi^{-\alpha_1 t}\sin\beta_1 t \tag{3}$$

When $V_P$ denotes the voltage across the terminals of the coil $L_P$, since $V_P=L_P(di/dt)$, $V_P$ can be expressed from the equation (3) as follows:

$$V_p = \frac{V_o\sqrt{\frac{L_p}{C_2}}}{\sqrt{\frac{L_p}{C_2}-\left(\frac{r_{on}}{2}\right)^2}}\cdot\xi^{-\alpha_1 t}\sin(\beta_1 t-\theta_1) \tag{4}$$

$\alpha_1$ and $\beta_1$ in the equation (4) can be expressed as $$\alpha_1 = \frac{r_{on}}{2L_p} \tag{5}$$

$$\beta_1 = \sqrt{\frac{1}{L_pC_2}-\left(\frac{r_{on}}{2L_p}\right)^2} \tag{6}$$

Therefore, when the circuit constants are determined to be:

$L_P=10$ μH, $C_2=0.2$ μF, $Ron=1.5$ ohm, from equations (5) and (6), $$\alpha=7.5\times10^5,\ \tan\theta_1=\beta_1/\alpha_1=9.3$$

Therefore, $\theta_1=1.46$ (rad), $\theta_1/\beta_1=2.1$ (μs). The period $T_{P1}$ of $V_P$ can be obtained from equation (4) as follows:

$$T_{P1}=2\pi/\beta_1=9\ (\mu s)$$

Further, if $t=o$, from equation (4)

$$V_P=-V_o$$

Figure 8:
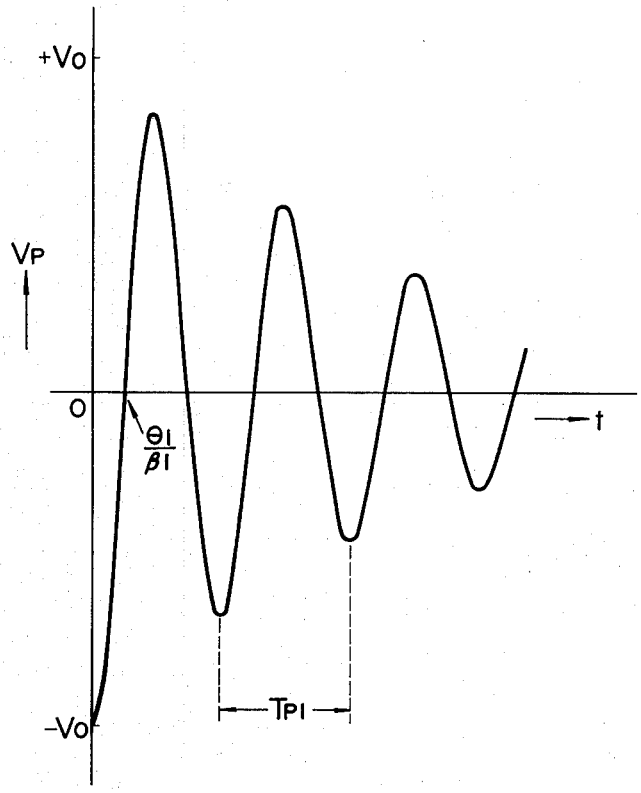
FIG. 8 is a graphical representation showing the transient state of the voltage $V_P$ developed across the primary coil of the boosting transformer after the discharge has been performed in the spark plug.

Being based on the above values, the voltage $V_P$ across the terminals of the coil $L_P$ given by equation (4)

can be expressed as a high frequency damped oscillation waveform with a peak value of $-V_o$ and a period $T_{P1}$ of 9 μs, as shown in FIG. 8.

Figure 9:
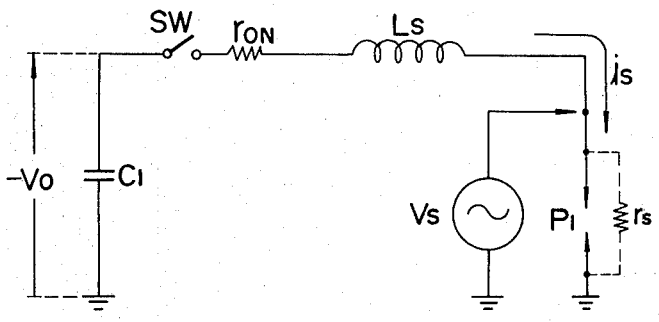
FIG. 9 is an equivalent circuit diagram including the secondary coil of the boosting transformer shown in FIG. 6(A)

FIG. 9 shows an equivalent circuit to that shown in FIG. 6(A) including the secondary coil $L_s$ of the boosting transformer T after the spark plug P begins to discharge therebetween. Here, the symbol $r_s$ denotes the discharge resistance between the electrodes of the spark plug P. Further, in this equivalent circuit, an AC supply voltage $V_s$ is N-times greater than the voltage $V_P$ generated between the terminals of the primary coil $L_P$, by which a discharge is produced between the central electrode and the side electrode of the spark plug P.

In such an equivalent circuit, the current $i_s$ flowing through the circuit during a period of time t after the switch SW has been turned on can be expressed as follows:

$$\text{if } R = r_{on} + r_s, \text{ and } R < 2\frac{L_s}{C_1}, \quad (7)$$

$$i_s = \frac{-2C_1V_o}{\sqrt{4L_sC_1 - R^2C_1^2}} \cdot \xi^{-\alpha_2 t} \cdot \sin \beta_2 t$$

Here, $\alpha_2$ and $\beta_1$ in equation (7) can be expressed by the following expressions:

$$\alpha_2 = \frac{R}{2L_s} \quad (8)$$

$$\beta_2 = \sqrt{\frac{1}{L_sC_1} - \left(\frac{R}{2L_s}\right)^2} \quad (9)$$

When the circuit constants are determined to be $L_s = 1$ mH, $C_1 = 1$ μF and the discharge resistance is $r_s = 30$ ohm (regarding $L_s$, if the inductance of the primary is 10 μH, and the winding ratio of the primary to the secondary is 1:10, the induction of the secondary $L_s$ is $10\ \mu H \times 10^2 = 1$ mH), since R=31.5 ohm, from equations (8) and (9), $\alpha_2 = 1.6 \times 10^4$ and $\beta_2 = 2.7 \times 10^4$.

Now, the minimum value of the current $i_s$ can be obtained by differentiating the current:

$$\frac{di_s}{dt} = \frac{2C_1V_o}{\sqrt{(4L_sC_1 - R^2C_1^2)L_sC_1}} \xi^{-\alpha_2 t} \cdot \sin(\beta_2 t - \theta_2) \quad (10)$$

where $$\tan \theta_2 = \frac{\beta_2}{\alpha_2} \quad (11)$$

$$\alpha_2^2 + \beta_2^2 = \frac{1}{L_sC_1}$$

In equation (10), when $d\ i_s/dt = 0$, that is, when $t_{p2} = \theta_2/\beta_2$, since $I_s$ is at its minimum value $I_{p2}$, by substituting $t = \theta_2/\beta_2$ into equation (7):

$$I_{p2} = \frac{-2C_1V_o}{\sqrt{4L_sC_1 - R_1^2C_1^2}} \cdot E^{-\frac{\alpha_2}{\beta_2}\theta_2} \cdot \sin \theta_2 \quad (12)$$

First, by substituting $\alpha_2 = 1.6 \times 10^4$ and $\beta_2 = 2.7 \times 10^4$ into equation (11), $\theta_2 = 1.0$ (rad) can be obtained. Therefore, by substituting $\theta_2 = 1$, $C_1 = 10^{-6}$, $L_s = 10^{-3}$, $R = 31.5$, and $V_o = 10^3$ into equation (12), the minimum current value becomes:

$$I_{p2} = -17A$$

where $$t_{p2} = 37\ \mu s.$$

Figure 10:
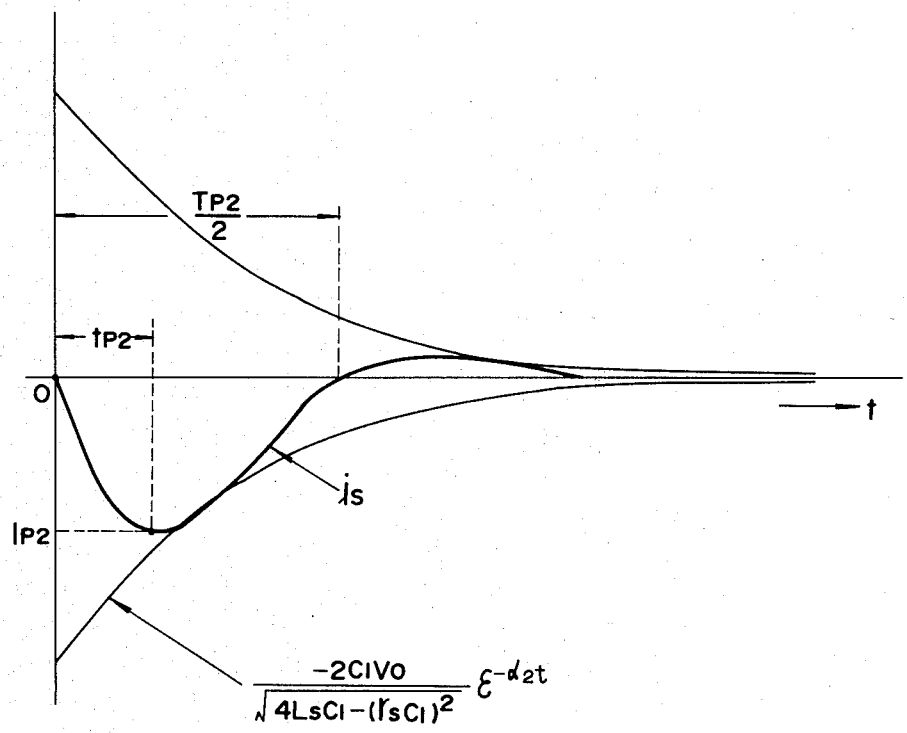
FIG. 10 is a graphical representation showing the transient state of the current $i_s$ flowing through the secondary coil of the boosting transformer after the discharge has been performed in the spark plug.

Further, since the period $T_{p2}$ of the current $i_s$ is $$T_{p2} = 2\pi/\beta_2 = 230\ \mu s$$

the discharge current $i_s$ flowing through the spark plug can be shown by a damped waveform with a peak value of $I_{p2} = -17$A as in FIG. 10. In other words, a high energy electric charge of about 0.5 Joule stored in the condenser $C_1$ is supplied to the spark plug for a short period of time of about $T_{p2}/2 = 115$ μs.

Figure 11:
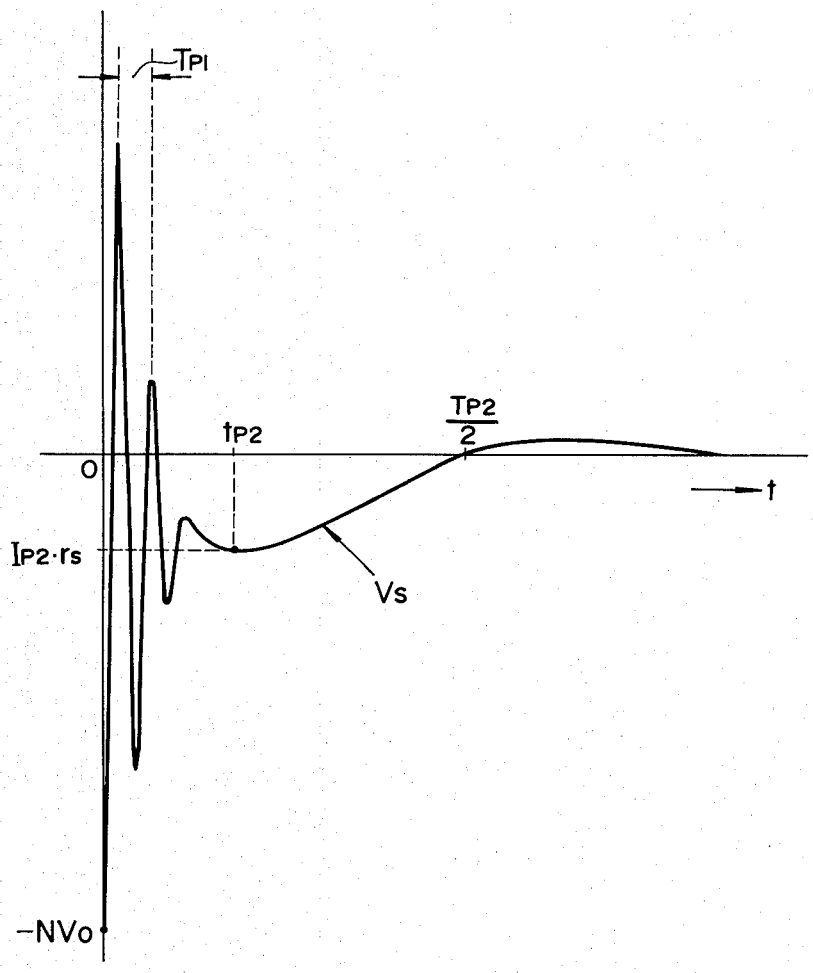
FIG. 11 is a graphical representation showing the transient state of the voltage developed across the electrodes of the spark plug.

The voltage $V_s$ applied between the terminals of the spark plug P at this moment can be approximately given by the following equation:

$$V_s = V_s + i_s \times r_s$$

and its waveform can be shown as in FIG. 11.

As described hereinabove since the plasma ignition system according to the present invention is so constructed that the condensers to store high ignition energy for each cylinder are independently connected to the output terminal of the DC-DC converter in order to perform plasma ignition by applying the current discharged from the condenser to the space between the electrodes of the spark plug through the boosting transformer when the switching unit is turned on at predetermined ignition times, it is possible to prevent irregular discharge between the electrodes, eliminate the need of high voltage resistant diodes in the discharge circuit, reduce the power consumption, and thus improve markedly the efficiency of the power supply for the ignition system.

Further, since the voltage across the condenser storing ignition energy can be made smaller according to the winding ratio of the boosting transformer, the durability of the switching unit can be improved, and since a single high tension cable can be used for supplying the spark discharge voltage and plasma ignition current, it is possible to make the wiring compact.

Furthermore, since the spark plug, boosting transformer, and auxiliary condenser are so arranged as to be covered by a metal shield, and a cylindrical noise-shorting condenser is provided in the casing around the wire, it is possible to prevent electrical noise generated when the spark plug is discharged from leaking out.

It will be understood by those skilled in the art that the foregoing description is in terms of preferred embodiments of the present invention wherein various changes and modifications may be made without departing from the spirit and scope of the invention, as set forth in the appended claims.

10 . . . DC-DC converter
11 . . . Switching unit
12 . . . Distribution control unit
12A . . . Ring counter
12B . . . Monostable multivibrator
13 . . . Crankshaft angle sensor
14 . . . Monostable multivibrator 15 . . . Switch
16 . . . Metal shield casing
P . . . Plasma spark plug
$C_1$ . . . Ignition energy condenser
$C_2$ . . . Auxiliary condenser
$C_3$ . . . cylindrical noise-shorting condenser
T . . . Boosting transformer
$D_1$ . . . First diode
$D_2$ . . . Second diode

What is claimed is:

1. A plasma ignition system for an internal combustion engine which comprises:

(a) a plurality of plasma spark plugs, one terminal of each being grounded;

(b) a DC-DC converter for boosting a DC supply voltage to a high tension;

(c) a plurality of ignition energy condensers for storing electric ignition energy, said ignition energy condensers being connected to the output of said DC-DC converter;

(d) a plurality of switching units each for applying the ignition energy charged in each of said ignition energy condensers to the respective plasma spark plug with an appropriate ignition timing, said switching units being connected to the output of said DC-DC converter in parallel with said respective ignition energy condenser with the other terminal thereof connected to the ground;

(e) a plurality of boosting transformers each for boosting the voltage across each ignition energy condenser to a still higher voltage, the common terminal of the respective primary and secondary coils being connected to said respective ignition energy condenser, the other terminal of the respective secondary coil being connected to the terminal of said respective plasma spark plug other than the grounded terminal; and (f) a plurality of auxiliary condensers each for connecting the other terminal of the primary coil of said respective boosting transformer to the ground, said auxiliary condensers forming an oscillation circuit together with the primary coil of said boosting transformer, whereby when said switching unit is turned on in order to discharge a current from said ignition energy condenser to said auxiliary condenser through the primary coil, a high tension is generated at the secondary coil of said boosting transformer so as to generate a spark between the electrodes of said plasma spark plug and subsequently a large current is passed through the electrodes of said plasma spark plug by the remaining plasma ignition energy stored in said ignition energy condenser so as to produce a plasma therebetween for completing the plasma ignition.

2. A plasma ignition system for an internal combustion engine as set forth in claim 1, which further comprises:

(a) a plurality of metal shield casings each for housing one each of said plurality of plasma spark plugs, boosting transformers, and auxiliary condensers together therewithin, said metal shields being grounded; and (b) a plurality of cylindrical noise-shorting condensers each for shorting out high frequency noise generated in the wire connecting said respective ignition energy condenser and said boosting transformer to the ground, said cylindrical condenser being disposed in a position passing through said metal shield casing, the wire connecting the condenser and transformer being passed through said cylindrical noise-shorting condenser, whereby electrical noise generated when plasma ignition is performed between the electrodes of said spark plug can be shielded.

3. A plasma ignition system for an internal combustion engine as set forth in claim 1, which further comprises a timing unit for outputting appropriate timing pulse signals to said plurality of switching units in order to apply ignition energy to said spark plugs, which comprises:

(a) a crankshaft angle sensor for outputting a pulse signal in synchronization with the crankshaft revolution; and (b) a multi-bit ring counter for outputting a plurality of independent pulse signals in order in response to the pulse signal sent from said crankshaft angle sensor in order to apply appropriate ignition timing signals to said respective switching units.

4. A plasma ignition system for an internal combustion engine as set forth in claim 3 which further comprises a plurality of monostable multivibrators each for outputting the respective pulse ignition timing signals with an appropriate constant pulse width to said respective switching units in response to the signal from said crankshaft angle sensor, said monostable multivibrators being connected between the respective outputs of said ring counter and said respective switching units.

5. A plasma ignition system for an internal combustion engine as set forth in claim 4 which further comprises:

(a) a switch for turning off said DC-DC converter, said switch being connected to the output terminal of said crankshaft angle sensor;

(b) a single monostable multivibrator for applying a pulse signal with an appropriate constant pulse width to said DC-DC converter to halt the function thereof for a predetermined period of time when said switch is turned on, said single monostable multivibrator being disposed between said crankshaft angle sensor and said DC-DC converter.

6. A plasma ignition system for an internal combustion engine as set forth in claim 1, which further comprises:

(a) a plurality of first diodes each for preventing the ignition energy stored in said ignition energy condensers from flowing back to said DC-DC converters; each of said respective first diodes being connected between the output of said DC-DC converter and said respective ignition energy condenser; and (b) a plurality of second diodes each for preventing current flowing through the primary coil of each of said respective boosting transformers when said ignition energy condenser is being charged up, one terminal of said respective second diode being connected between said respective ignition energy condenser and said respective boosting transformer and the other terminal thereof being connected to the ground.

7. A plasma ignition system for an internal combustion engine as set forth in claim 1, wherein one of said plurality of switching units includes a high voltage resistant semiconductor switching element.

8. A plasma ignition system for an internal combustion engine as set forth in claim 7, wherein said high voltage resistant semiconductor is a thyristor.

9. A plasma ignition system for an internal combustion engine as set forth in claim 7, wherein said high voltage resistant semiconductor is a high voltage resistant transistor.

10. A plasma ignition system for an internal combustion engine as set forth in claim 7, wherein said high voltage resistant semiconductor is a field effect transistor.

11. A plasma ignition system for an internal combustion engine as set forth in claim 1, wherein said plurality of auxiliary condensers are smaller in capacity than said plurality of ignition energy condensers.

12. A plasma ignition system for an internal combustion engine as set forth in any of claims 1, 2 and 6, wherein the number of each of said plasma spark plugs, ignition energy condensers, switching units, boosting transformers, auxiliary condensers, metal shielding casings, cylindrical noise-shorting condensers, first diodes, and second diodes is the same as that of the cylinders of the internal combustion engine.

13. A plasma ignition system for an internal combustion engine as set forth in any of claims 3 and 4, wherein the number of each of said multi-bit ring counters, and monostable multivibrators is the same as that of the cylinders of the internal combustion engine.

14. A method of plasma-igniting the fuel in the cylinders of an internal combustion engine, which comprises the steps of:

(a) boosting a supply voltage to a high tension;

(b) storing the boosted high-tension ignition energy in a plurality of condensers;

(c) discharging part of the ignition energy stored in each condenser through an oscillation circuit including the primary coil of a boosting transformer and an auxiliary condenser so as to generate a spark due to a still higher voltage across the secondary coil thereof at the appropriate ignition timing, so that the space between the electrodes of the spark plug becomes conductive with a certain discharge resistance; and (d) discharging the remaining energy stored in the condenser, through the secondary coil of the boosting transformer, to the space between the electrodes of the spark plug so as to produce a plasma therebetween for igniting the mixture within the cylinder.

15. A method of plasma-igniting the fuel in the cylinders of an internal combustion engine as set forth in claim 14, wherein the boosted high-tension ignition energy is stored independently in a separate condenser provided for each cylinder.

16. A method of plasma-igniting the fuel within the cylinders of an internal combustion engine as set forth in claim 14, wherein the high-tension ignition energy charged in each condenser is discharged independently through the respective boosting transformer provided for the respective cylinder in accordance with the respective ignition timings.

17. A method of plasma-igniting the fuel within the cylinders of an internal combustion engine as set forth in claim 14, wherein the appropriate ignition timing is produced by detecting the predetermined revolution angles of a crankshaft.

18. A method of plasma-igniting the fuel within the cylinders of an internal combustion engine as set forth in claim 14, wherein the respective boosting transformers, the respective auxiliary condensers, and the respective spark plugs are covered by a metal shield casing with the casing being connected to the ground, and the wire connecting the boosting transformer to the ignition energy condenser is taken out through a cylindrical noise-shorting condenser provided in an appropriate portion of the metal shield casing, so that electrical noise generated when plasma ignition is performed can be shielded.

* * * * *